US007270196B2

(12) United States Patent
Hall

(10) Patent No.: US 7,270,196 B2
(45) Date of Patent: Sep. 18, 2007

(54) DRILL BIT ASSEMBLY

(76) Inventor: David R. Hall, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 11/164,391

(22) Filed: Nov. 21, 2005

(65) Prior Publication Data

US 2007/0114065 A1 May 24, 2007

(51) Int. Cl.
*E21B 10/26* (2006.01)

(52) U.S. Cl. ..... 175/57; 175/321; 175/381; 175/385

(58) Field of Classification Search ..... 175/381, 175/389, 404, 408, 385, 321, 407, 382
See application file for complete search history.

(56) References Cited

U.S. PATENT DOCUMENTS 465,103 A 12/1891 Wegner
616,118 A 12/1898 Kuhne
946,060 A 1/1910 Looker
1,116,154 A 11/1914 Stowers
1,183,630 A 5/1916 Bryson
1,189,560 A 7/1916 Gondos
1,360,908 A 11/1920 Everson
1,372,257 A * 3/1921 Swisher ..... 175/381
1,387,733 A 8/1921 Midgett
1,460,671 A 7/1923 Hebsacker
1,544,757 A 7/1925 Hufford
1,746,455 A * 2/1930 Woodruff et al. ..... 175/298
1,821,474 A 9/1931 Mercer
2,022,101 A * 11/1935 Wright ..... 175/293
2,054,255 A 9/1936 Howard
2,169,223 A 8/1939 Christian
2,218,130 A 10/1940 Court
2,320,136 A 5/1943 Kammerer
2,345,024 A * 3/1944 Bannister ..... 173/31
2,466,991 A 4/1949 Kammerer
2,540,464 A 2/1951 Stokes
2,544,036 A 3/1951 Kammerer
2,725,215 A * 11/1955 MacNeir ..... 175/298
2,755,071 A 7/1956 Kammerer
2,819,041 A * 1/1958 Beckham ..... 175/93
2,877,984 A * 3/1959 Causey ..... 175/106
2,901,223 A 8/1959 Scott
2,963,102 A 12/1960 Smith
2,998,085 A * 8/1961 Dulaney ..... 175/100
3,379,264 A 4/1968 Cox
3,493,165 A 2/1970 Schonfeld
3,960,223 A 6/1976 Kleine
4,081,042 A 3/1978 Johnson
4,106,577 A 8/1978 Summers
4,307,786 A 12/1981 Evans
4,386,669 A * 6/1983 Evans ..... 175/269
4,416,339 A 11/1983 Baker (Continued)

*Primary Examiner*—Hoang Dang
(74) *Attorney, Agent, or Firm*—Tyson J. Wilde

(57) ABSTRACT

In one aspect of the present invention a drill bit assembly comprises a body portion intermediate a shank portion and a working portion. The working portion has at least one cutting element. The body portion has at least a portion of a reactive jackleg apparatus which has a chamber at least partially disposed within the body portion and a shaft movably disposed within the chamber, the shaft having at least a proximal end and a distal end. The chamber also has an opening proximate the working portion of the assembly.

16 Claims, 7 Drawing Sheets

U.S. PATENT DOCUMENTS

| | | | | | |
|---|---|---|---|---|---|
| 4,448,269 | A | | 5/1984 | Ishikawa | |
| 4,478,296 | A | * | 10/1984 | Richman, Jr. | 175/92 |
| 4,531,592 | A | | 7/1985 | Hayatdavoudi | |
| 4,566,545 | A | | 1/1986 | Story | |
| 4,962,822 | A | | 10/1990 | Pascale | |
| 5,009,273 | A | | 4/1991 | Grabinski | |
| 5,038,873 | A | | 8/1991 | Jurgens | |
| 5,088,568 | A | * | 2/1992 | Simuni | 175/14 |
| 5,141,063 | A | | 8/1992 | Quesenbury | |
| 5,361,859 | A | | 11/1994 | Tibbitts | |
| 5,417,292 | A | | 5/1995 | Polakoff | |
| 5,507,357 | A | | 4/1996 | Hult | |
| 5,560,440 | A | | 10/1996 | Tibbitts | |
| 5,568,838 | A | | 10/1996 | Struthers | |
| 5,678,644 | A | | 10/1997 | Fielder | |
| 5,896,938 | A | | 4/1999 | Moeny | |
| 6,202,761 | B1 | | 3/2001 | Forney | |
| 6,439,326 | B1 | | 7/2002 | Huang | |
| 6,533,050 | B2 | | 3/2003 | Molloy | |
| 6,601,454 | B1 | | 8/2003 | Botnan | |
| 6,668,949 | B1 | | 12/2003 | Rives | |
| 6,732,817 | B2 | | 5/2004 | Dewey | |
| 6,929,076 | B2 | | 4/2005 | Fanuel | |
| 6,953,096 | B2 | | 10/2005 | Gledhill | |

* cited by examiner

DRILL BIT ASSEMBLY

BACKGROUND OF THE INVENTION

This invention relates to drill bits, specifically drill bit assemblies for use in oil, gas and geothermal drilling. Often drill bits are subjected to harsh conditions when drilling below the earth's surface. Replacing damaged drill bits in the field is often costly and time consuming since the entire downhole tool string must typically be removed from the borehole before the drill bit can be reached. Bit whirl in hard formations may result in damage to the drill bit and reduce penetration rates. Further loading too much weight on the drill bit when drilling through a hard formation may exceed the bit's capabilities and also result in damage. Too often unexpected hard formations are encountered suddenly and damage to the drill bit occurs before the weight on the drill bit can be adjusted.

The prior art has addressed bit whirl and weight on bit issues. Such issues have been addressed in the U.S. Pat. No. 6,443,249 to Beuershausen, which is herein incorporated by reference for all that it contains. The '249 patent discloses a PDC-equipped rotary drag bit especially suitable for directional drilling. Cutter chamfer size and backrake angle, as well as cutter backrake, may be varied along the bit profile between the center of the bit and the gage to provide a less aggressive center and more aggressive outer region on the bit face, to enhance stability while maintaining side cutting capability, as well as providing a high rate of penetration under relatively high weight on bit.

U.S. Pat. No. 6,298,930 to Sinor which is herein incorporated by reference for all that it contains, discloses a rotary drag bit including exterior features to control the depth of cut by cutters mounted thereon, so as to control the volume of formation material cut per bit rotation as well as the torque experienced by the bit and an associated bottomhole assembly. The exterior features preferably precede, taken in the direction of bit rotation, cutters with which they are associated, and provide sufficient bearing area so as to support the bit against the bottom of the borehole under weight on bit without exceeding the compressive strength of the formation rock.

U.S. Pat. No. 6,363,780 to Rey-Fabret which is herein incorporated by reference for all that it contains, discloses a system and method for generating an alarm relative to effective longitudinal behavior of a drill bit fastened to the end of a tool string driven in rotation in a well by a driving device situated at the surface, using a physical model of the drilling process based on general mechanics equations. The following steps are carried out: the model is reduced so to retain only pertinent modes, at least two values Rf and Rwob are calculated, Rf being a function of the principal oscillation frequency of weight on hook WOH divided by the average instantaneous rotating speed at the surface, Rwob being a function of the standard deviation of the signal of the weight on bit WOB estimated by the reduced longitudinal model from measurement of the signal of the weight on hook WOH, divided by the average weight on bit defined from the weight of the string and the average weight on hook. Any danger from the longitudinal behavior of the drill bit is determined from the values of Rf and Rwob.

U.S. Pat. No. 5,806,611 to Van Den Steen which is herein incorporated by reference for all that it contains, discloses a device for controlling weight on bit of a drilling assembly for drilling a borehole in an earth formation. The device includes a fluid passage for the drilling fluid flowing through the drilling assembly, and control means for controlling the flow resistance of drilling fluid in the passage in a manner that the flow resistance increases when the fluid pressure in the passage decreases and that the flow resistance decreases when the fluid pressure in the passage increases.

U.S. Pat. No. 5,864,058 to Chen which is herein incorporated by reference for all that is contains, discloses a downhole sensor sub in the lower end of a drillstring, such sub having three orthogonally positioned accelerometers for measuring vibration of a drilling component. The lateral acceleration is measured along either the X or Y axis and then analyzed in the frequency domain as to peak frequency and magnitude at such peak frequency. Backward whirling of the drilling component is indicated when the magnitude at the peak frequency exceeds a predetermined value. A low whirling frequency accompanied by a high acceleration magnitude based on empirically established values is associated with destructive vibration of the drilling component. One or more drilling parameters (weight on bit, rotary speed, etc.) is then altered to reduce or eliminate such destructive vibration.

BRIEF SUMMARY OF THE INVENTION

In one aspect of the present invention a drill bit assembly comprises a body portion intermediate a shank portion and a working portion. The working portion has at least one cutting element. The body portion has at least a portion of a reactive jackleg apparatus which has a chamber at least partially disposed within the body portion and a shaft movably disposed within the chamber, the shaft having at least a proximal end and a distal end. The chamber also has an opening proximate the working portion of the assembly. In the preferred embodiment, the shank portion is adapted for connection to a downhole tool string component for use in oil, gas, and/or geothermal drilling; however, the present invention may be used in drilling applications involved with mining coal, diamonds, copper, iron, zinc, gold, lead, rock salt, and other natural resources, as well as for drilling through metals, woods, plastics and related materials.

The shaft may be retractable which may protect the shaft from damage as the drill bit assembly is lowered into an existing borehole. During a drilling operation the shaft may be extended such that the distal end of the shaft protrudes beyond the working portion of the assembly. The distal end of the shaft may comprise at least one nozzle, at least one cutting element, or various geometries for improving penetration rates, reducing bit whirl, and/or controlling the flow of debris from the subterranean formation.

The proximal end of the shaft and/or an enlarged portion of the shaft may be in fluid communication with bore of the tool string. In such an embodiment pressure exerted from drilling mud or air may force the distal end of the shaft to protrude beyond the working portion of the assembly. In soft subterranean formations, the distal end may travel with respect to the body portion a maximum distance; in such an embodiment the shaft may stabilize the drill bit assembly as it rotates reducing vibrations of the tool string. In harder formations the compressive strength of the formation may resist the movement of the shaft. In such an embodiment, the jackleg apparatus may absorb some of the formation's resistance and also transfer a portion of the resistance to the tool string through either physical contact or through a pressurized bore of the tool string. It is believed that the drilling mud pressurizes the bore of the tool string and that resistance transferred from the shaft to the pressurized bore will lift the tool string. In such embodiments, at least a portion of the weight of the tool string will be loaded to the shaft allowing the weight of the tool string to be focus immediately in front of the distal end of the shaft and thereby crush a portion of the subterranean formation. Since at least a portion of the weight of the tool string is focused in the distal end, bit whirl may be minimized even in hard formations. In such a situation, depending on the geometry of the distal end of the shaft, the distal end may force a portion of the subterranean formation outward placing it in a path of the cutting elements.

Another useful result of loading the shaft with the weight of the tool string is that it subtracts some of the load felt by the working portion of the drill bit assembly. By subtracting the load on the working portion automatically through the jackleg apparatus when an unknown hard formation is encountered, the cutting elements may avoid a sudden impact into the hard formation which may potentially damage the working portion and/or the cutting elements.

The distal end of the shaft may comprise a wear resistant material. Such a material may be diamond, boron nitride, or a cemented metal carbide. The shaft may also be made a wear resistant material such a cemented metal carbide, preferably tungsten carbide.

DETAILED DESCRIPTION OF THE INVENTION AND THE PREFERRED EMBODIMENT

Figure 1:
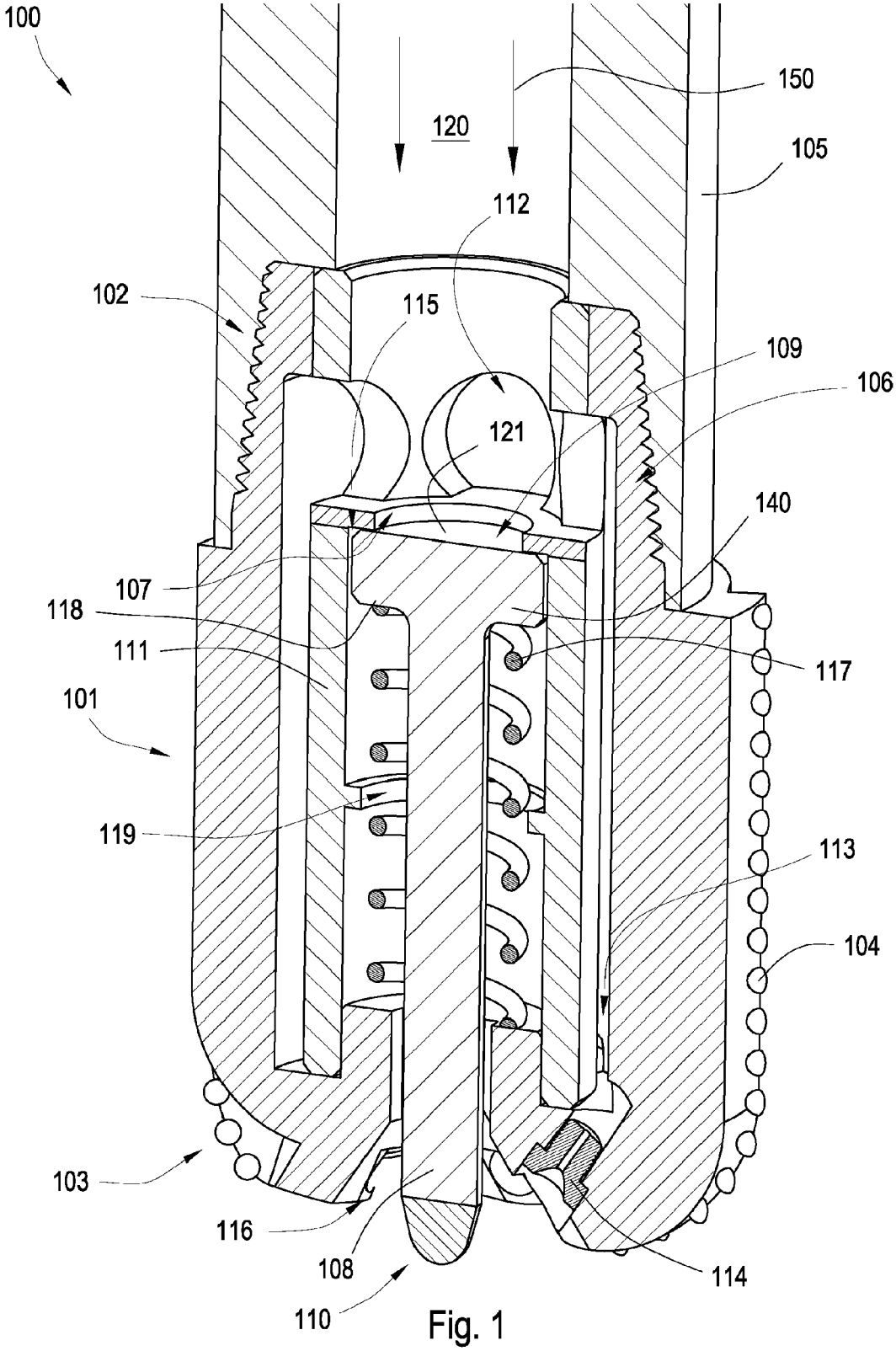
FIG. 1 is a cross sectional diagram of a preferred embodiment of a drill bit assembly.

FIG. 1 is a cross sectional diagram of a preferred embodiment of a drill bit assembly 100. The drill bit assembly 100 comprises a body portion 101 intermediate a shank portion 102 and a working portion 103. In this embodiment, the shank portion 102 and body portion 101 are formed from the same piece of metal although the shank portion 102 may be welded or otherwise attached to the body portion 101. The working portion 103 comprises a plurality of cutting elements 104. In other embodiments, the working portion 103 may comprise cutting elements 104 secured to a roller cone or the drill bit assembly 100 may comprise cutting elements 104 impregnated into the working portion 103. The shank portion 102 is connected to a downhole tool string component 105, such as a drill collar or heavy weight pipe, which may be part of a downhole tool string used in oil, gas, and/or geothermal drilling.

A reactive jackleg apparatus 106 is generally coaxial with the shank portion 102 and disposed within the body portion 101. The reactive jackleg apparatus 106 comprises a chamber 107 disposed within the body portion 101 and a shaft 108 is movably disposed within the chamber 107. The shaft 108 comprises a proximal end 109 and a distal end 110. The shaft 108 and/or the proximal end 109 may have an enlarged portion 140. A sleeve 111 is disposed within the chamber 107 and surrounds the shaft 108. A fluid port 112 in the sleeve 111 is in fluid communication with a fluid channel 113 that leads to nozzles 114 secured within the working portion 103 of the drill bit assembly 100. In the embodiment of FIG. 1, there is a space 115 between the enlarged portion 140 of the shaft 108 and the sleeve 111 such that some drilling mud, air, or other fluid may travel around the enlarged portion 140 of the shaft 108 and exit the chamber 107 through an opening 116 proximate the working portion 103 of the drill bit assembly 100. A spring 117 is secured within the chamber 107 which engages a bottom face 118 of the enlarged portion 140 and biases the shaft 108 to assume a retracted position 119.

During a drilling operation, drilling mud may travel through the bore 120 of the tool string and engage the top face 121 of the shaft's proximal end 109 and/or the enlarged portion 140, exerting a pressure (bore pressure 150) on the shaft 108. Some of the bore pressure may be released through the fluid ports and the space 115 between the enlarged portion 140 and the sleeve 111. Although some of the bore pressure is released, it is believed that a constant pressure may be maintained within the bore 120 of the tool string by circulating the drilling mud back into the bore 120 as the drilling mud travels up the annulus. In some embodiments, air is forced through the bore 120 of the tool string such as in drilling applications near the surface.

While drilling through soft subterranean formations, the bore pressure may overcome both the spring (spring pressure) and also the compressive strength (formation pressure) of the soft formation. In harder subterranean formations, the formation pressure may increase, changing the equilibrium between the spring pressure, bore pressure and the formation pressure. The new equilibrium may result in changing the position of the shaft 108. The jackleg apparatus 106 is reactive since is adjusts the weight loaded to the working portion 103 of the drill bit assembly 100 in response to changes in formation pressure. Since the bore is pressurized, when an equilibrium change occurs, it may shift the shaft into the bore resulting in the bore pressure pushing up on the tool string. Pushing up on the tool string will result in less weight loaded to the working portion 103 of the drill bit assembly 100. Thus in drilling applications where unexpected hard formations are encounter suddenly, a reduction of the weight on the working portion 103 may occur automatically and thereby reduce potential damage to the drill bit assembly 100. Further, the weight on the working portion 103 of the drill bit assembly 100 may be controlled by changing the bore pressure, such as by increasing or decreasing the amount of drilling mud forced into the bore 120 of the tool string.

The shaft 108 may be generally cylindrically shaped, generally rectangular, or generally polygonal. The shaft 108 may be keyed or splined within the chamber 107 to prevent the shaft 108 from rotating independently of the body portion 101; however, in some embodiments, the shaft 108 may rotate independent of the body portion 101. The distal end 110 of the shaft may comprise a hard material such as diamond, boron nitride, or a cemented metal carbide. Preferably, the distal end comprises diamond bonded to the rest of the shaft 108. The diamond may be bonded to the shaft with any non-planar geometry at the interface between the diamond and the rest of the shaft. The diamond may be sintered to a carbide piece in a high temperature high pressure press and then the carbide piece may be bonded to the rest of the shaft. The shaft may comprise a cemented metal carbide, such as tungsten or niobium carbide. In some embodiments, the shaft may comprise a composite material and/or a nickel based alloy.

Figure 2:
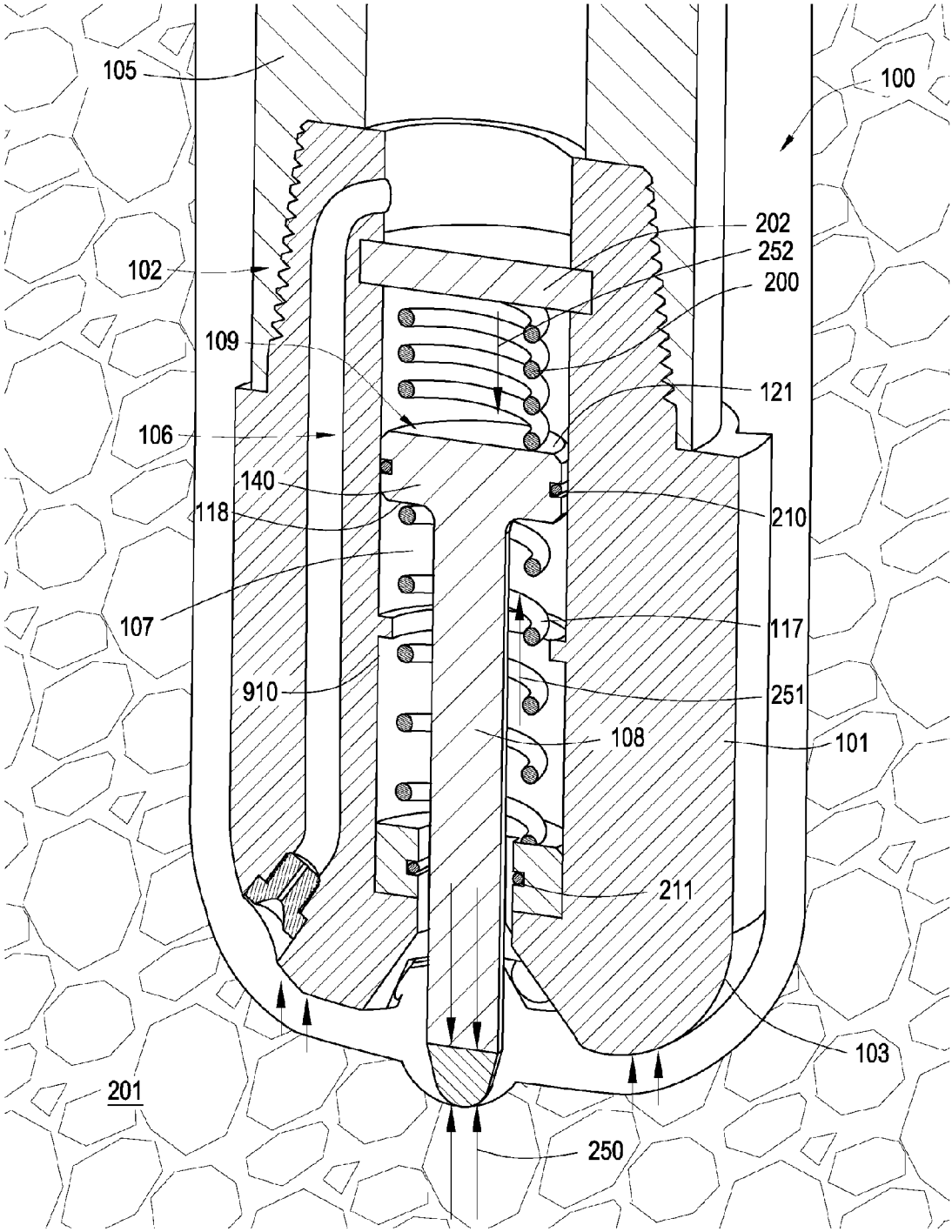
FIG. 2 is a cross sectional diagram of another embodiment of a drill bit assembly.

FIG. 2 is a cross sectional diagram of another embodiment of a drill bit assembly 100. In this embodiment, opposing spring pressures 251, 252 and a formation pressure 250 may determine the position of the shaft 108. A first spring 200 is generally coaxial with the jackleg apparatus 106 and disposed with the chamber 107. The first spring 200 engages the top face 121 of the shaft's enlarged portion 140 pushing the shaft against the subterranean formation 201. A second spring 117 engages the bottom face 118 of the enlarged portion 140. In this embodiment the first spring 200 transfers the formation pressure to a plate 202, which physically contacts the body portion 101 of the drill bit assembly 100. In other embodiments, the plate 202 may contact the tool string component 105 directly. In this manner, the weigh loaded to the working portion 103 of the drill bit assembly 100 may be reduced. Spring 200 may absorb shocks or other vibrations that may be induced during drilling. Sealing elements 210 may be intermediate the shaft 108 and the wall 901 of the chamber 107, which may prevent fluid from entering the chamber 107 and corroding the spring 200. Another sealing element 211 may be intermediate the wall 901 of the chamber 107 and shaft 108.

During manufacturing, the chamber may be formed in the body portion 101 with a mill or lathe. In other embodiments, the chamber 107 may also be inserted into the body portion 101 from the shank portion 102. The reactive jackleg apparatus 106 of either FIGS. 1 or 2 may be inserted from the from the shank portion 102.

Figure 3:
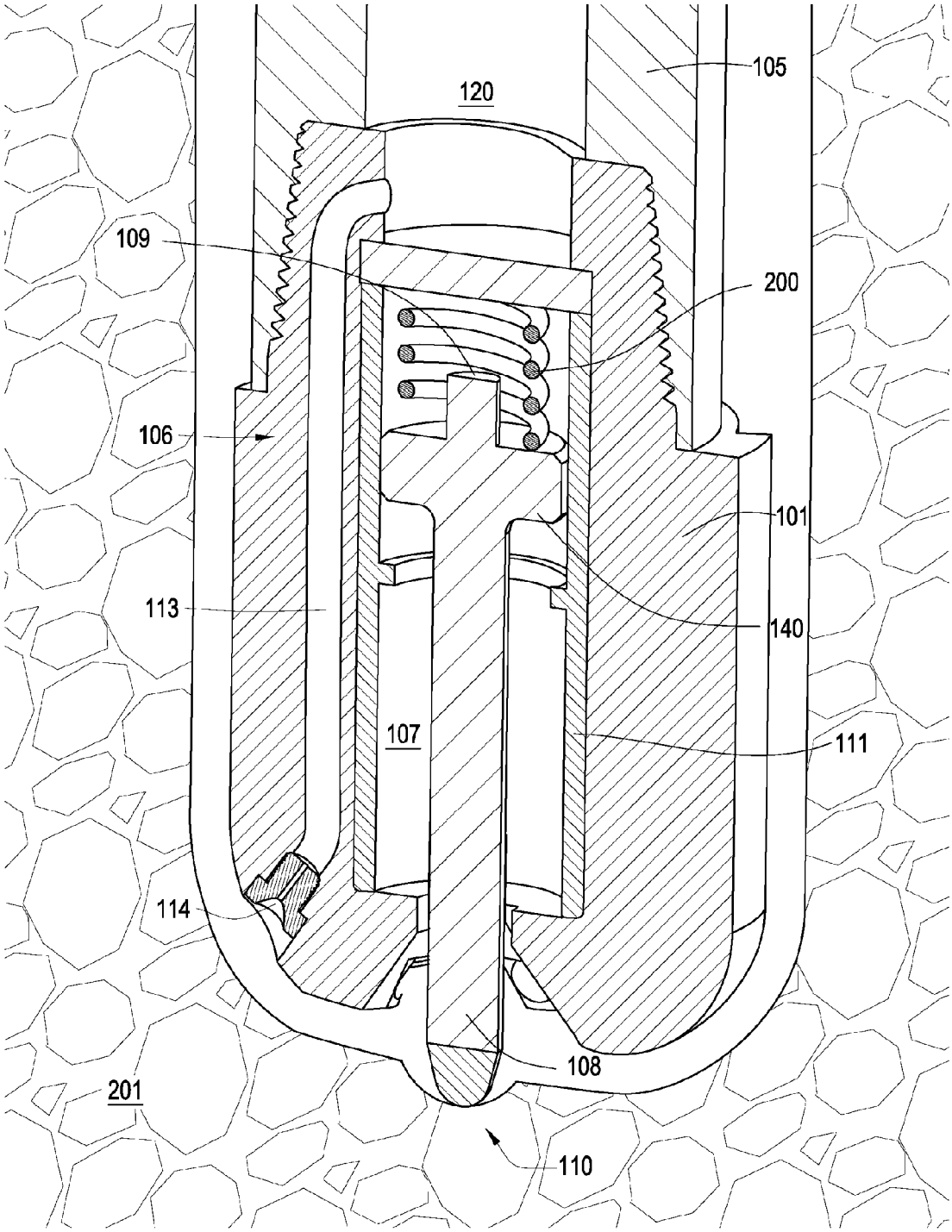
FIG. 3 is a cross sectional diagram of another embodiment of a drill bit assembly.

FIG. 3 is a cross sectional diagram of another embodiment of a drill bit assembly 100. In this embodiment, the jackleg apparatus 106 comprises a sleeve 111 splined to the enlarged portion 140 of the shaft 108. The sleeve comprises a landing 400, which prevents the enlarged portion 140 of the shaft 108 from extending too far. The proximal end of the shaft 108 extends beyond the enlarged portion 140 of the shaft 108 and limits the range that the shaft 108 may travel; thereby, reducing unneeded strain on the spring 200. Fluid channels 113 are in communication with the nozzles 114 and the bore 120 of the tool string component 105. The jackleg apparatus 106 may provide additional stabilization and reduce bit whirl while drilling through hard formations. In some embodiments of the present invention, a portion of the chamber 107, spring 200, and/or shaft 108 may extend into the bore 120 of the downhole tool string component 105.

Figure 4:
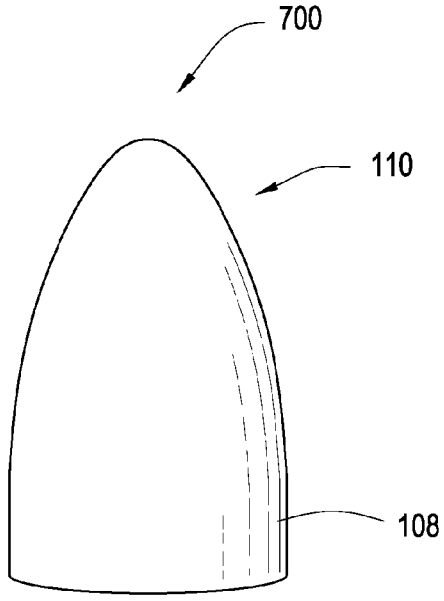
FIG. 4 is a perspective diagram of another embodiment of a distal end comprising a cone shape.
Figure 5:
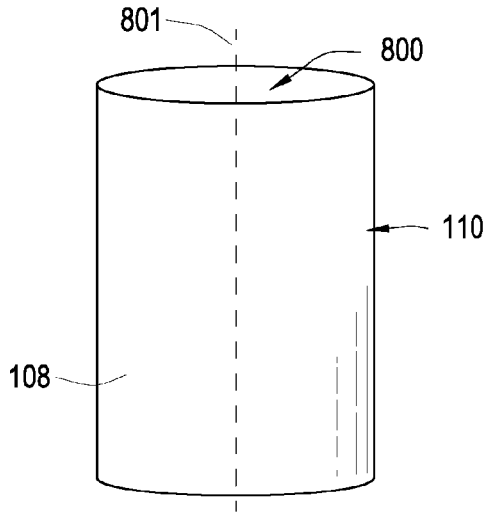
FIG. 5 is a perspective diagram of another embodiment of a distal end comprising a face normal to an axis of a shaft.
Figure 6:
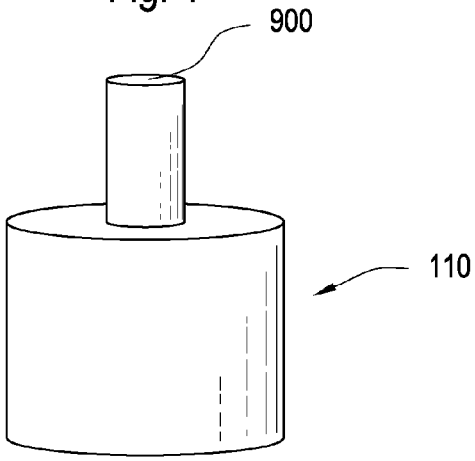
FIG. 6 is a perspective diagram of another embodiment of a distal end comprising a raised face.
Figure 7:
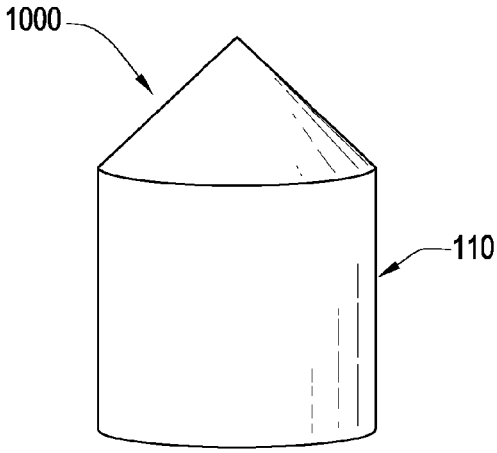
FIG. 7 is a perspective diagram of another embodiment of a distal end comprising a pointed tip.
Figure 8:
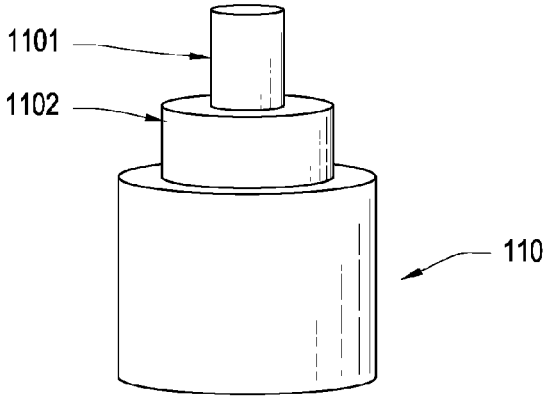
FIG. 8 is a perspective diagram of another embodiment of a distal end comprising a plurality of raised portions.
Figure 9:
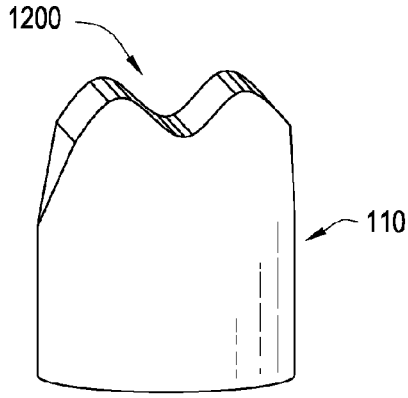
FIG. 9 is a perspective diagram of another embodiment of a distal end comprising a wave shaped face.
Figure 10:
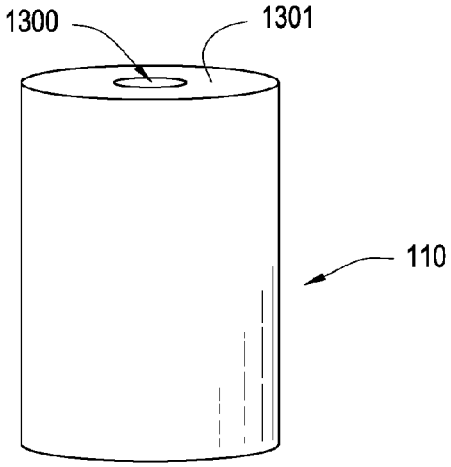
FIG. 10 is a perspective diagram of another embodiment of a distal end comprising a central bore.
Figure 11:
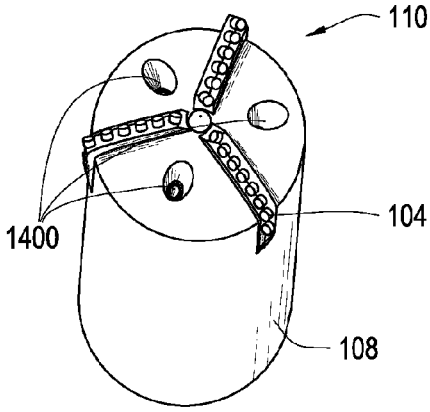
FIG. 11 is a perspective diagram of another embodiment of a distal end comprising a nozzle.

FIGS. 4-11 are perspective diagrams of various embodiments of the distal end 110 of the shaft 108. In FIG. 4 the distal end 110 comprises a plain cone 700. FIG. 5 shows a distal end 110 with a face 800 normal to a central axis 801 of the shaft 108. FIG. 6 shows a distal end 110 with a raised face 900. The distal end 110 of FIG. 7 comprises a pointed tip 1000. In other embodiments the distal end may comprise a rounded tip. The distal end 110 shown in FIG. 8 shows a plurality of raised portions 1101, 1102. FIG. 9 is a perspective diagram of a distal end 110 with a wave shaped face 1200. FIG. 10 shows a distal end with a bore 1300 formed in an end face 1301. As shown in FIG. 11, at least one nozzle 1400 may be located at the distal end 110 to cool the shaft 108, circulate cuttings generated by the shaft 108, and/or erode a portion of the subsurface formation. Further the distal end 110 may also comprise at least one cutting element 104.

Figure 12:
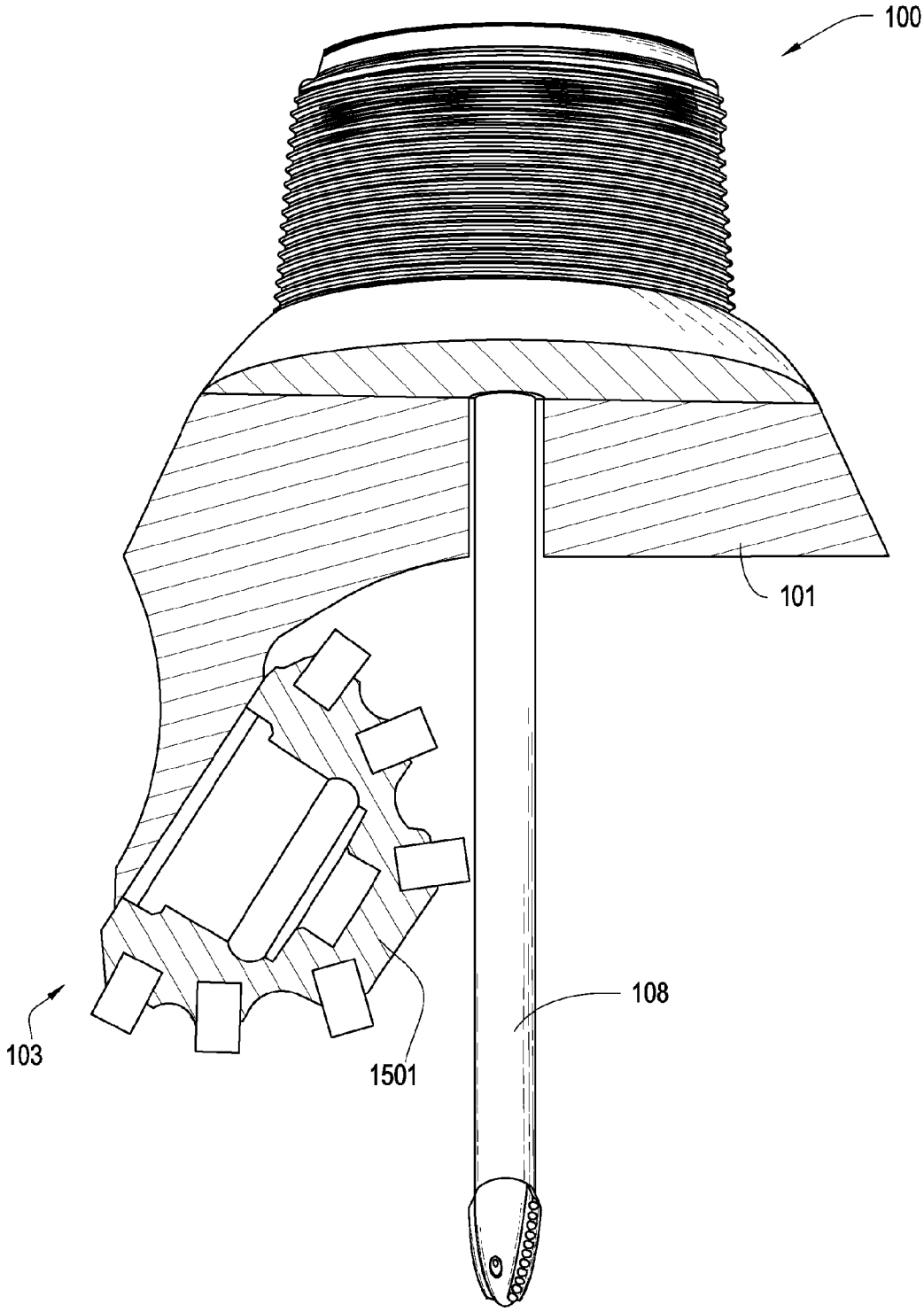
FIG. 12 is a perspective diagram of an embodiment of a roller cone drill bit assembly.

FIG. 12 is a perspective diagram of an embodiment of a drill bit assembly 100 comprising a working portion 103 with at least one roller cone 1501. The embodiment of this figure comprises shaft 108 extending beyond the body portion 101 and also the working portion 103 of the assembly 100. The shaft 108 may be positioned in the center of the working portion 103.

Figure 13:
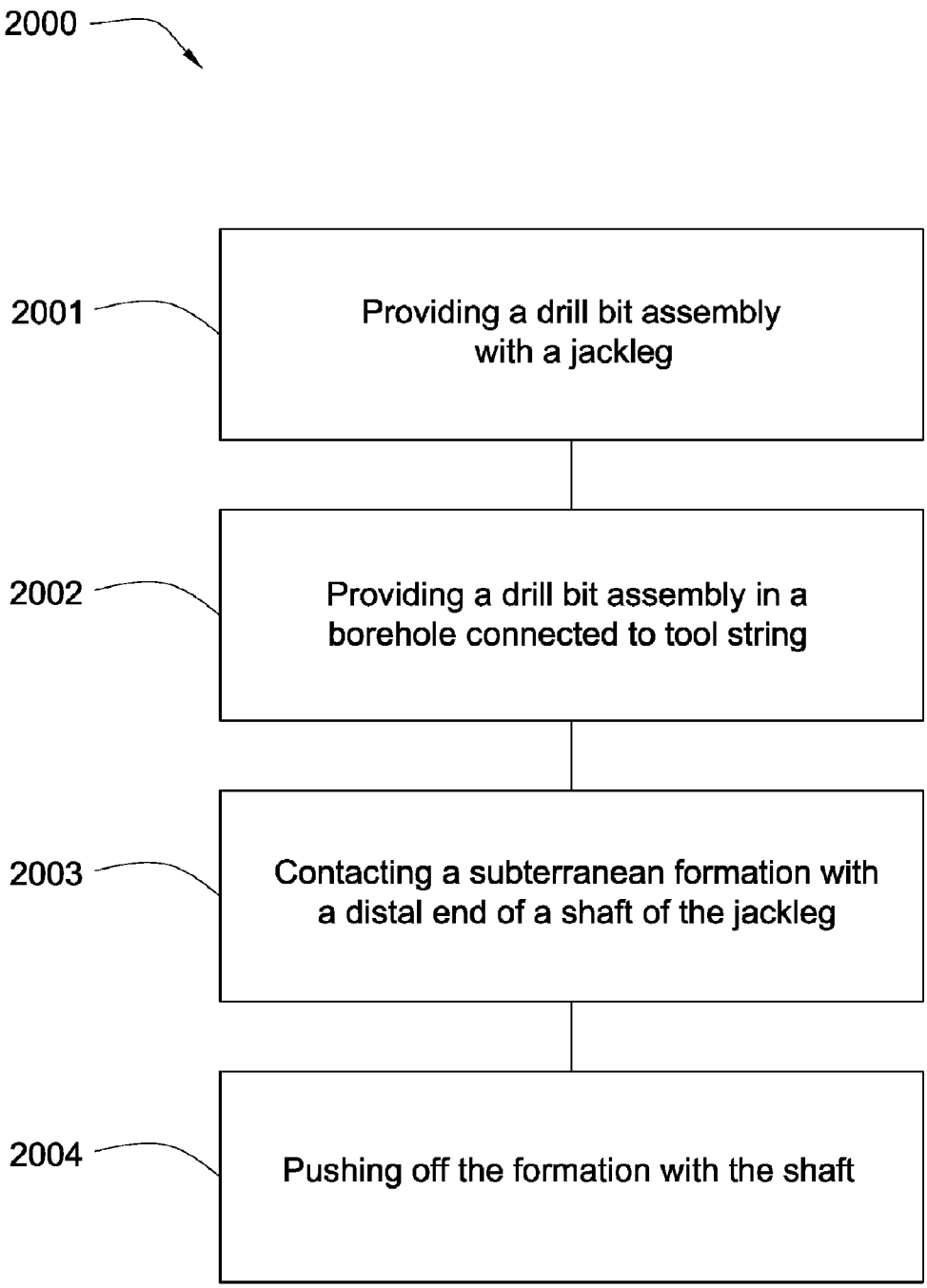
FIG. 13 is a diagram of a method for controlling weight loaded to a working portion of a drill bit assembly.

FIG. 13 is a diagram of a method 2000 for controlling weight loaded to a working portion of a drill bit assembly. The method 2000 includes providing 2001 a drill bit assembly with a working portion and a reactive jackleg disposed within at least a portion of the assembly, the jackleg comprising a shaft with a distal end. The method also includes providing 2002 the drill bit assembly in a borehole connected to a downhole tool string. Further the method 2000 includes contacting 2003 a subterranean formation with the distal end of the shaft and pushing 2004 off of the formation with the shaft. The pushing off of the shaft may occur automatically in response to changes in formation pressure or is may occur from increasing pressure within the bore of the downhole tool string. The pressure may be increased by forcing more air or drilling mud into the bore of the tool string. The shaft may be retracted while the drill bit assembly is being lowered into a bore and then retracted such that the working portion of the assembly contacts the formation first. The shaft may also reduce bit whirl. In the preferred embodiment, the jackleg is substantially coaxial with the drill bit assembly.

Whereas the present invention has been described in particular relation to the drawings attached hereto, it should be understood that other and further modifications apart from those shown or suggested herein, may be made within the scope and spirit of the present invention.

What is claimed is:

1. A drill bit assembly, comprising:

a body portion intermediate a shank portion and a working portion, the shank portion being adapted for connection to a downhole tool string;

the working portion comprising at least one cutting element fixed with respect to the body portion;

the body portion comprising at least a portion of a reactive jackleg apparatus that is generally coaxial with the shank portion;

the reactive jackleg apparatus comprising a chamber at least partially disposed within the body portion and a shaft movably disposed within the chamber, the shaft comprising an enlarged portion and a hard metal distal end;

the chamber comprising an opening proximate the working portion, through which drilling mud from the bore and the distal end of the shaft exit the drill bit; and the enlarged portion of the shaft is in fluid communication with a bore formed in the tool string;

wherein a position of the shaft is determined by at least a combination of a formation pressure and a fluid bore pressure generated by drilling mud;

wherein the enlarged portion of the shaft engages a spring.

2. The drill bit assembly of claim 1, wherein the distal end comprises a wear resistant material.

3. The drill bit assembly of claim 1, wherein the enlarged portion is movable to a closed position blocking said opening.

4. The drill bit assembly of claim 1, wherein the spring generally coaxial with the reactive jackleg apparatus is positioned within the chamber and engages the shaft.

5. The drill bit assembly of claim 1, wherein the distal end comprises at least one nozzle.

6. The drill bit assembly of claim 1, wherein the shaft is retractable.

7. The drill bit assembly of claim 1, wherein the distal end of the shaft protrudes beyond the working portion.

8. The drill bit assembly of claim 1, wherein the body portion comprises at least one fluid port in communication with the chamber and the working portion.

9. The drill bit assembly of claim 1, wherein a position of the shaft is also determined by a spring pressure.

10. A method for controlling weight loaded to a working portion of a drill bit assembly, comprising:

providing a fixed cutter drill bit assembly with a working portion and a reactive jackleg disposed within at least a portion of the assembly and being generally coaxial with shank portion of the drill bit assembly, the jackleg comprising a shaft with a hard metal distal end and an enlarged potion of the reactive jackleg is in fluid communication with a bore formed in the body portion of the drill bit assembly, the enlarged portion of the shaft engaging a spring;

providing the drill bit assembly in a borehole connected to a downhole tool string, and the enlarged portion of the reactive jackleg is in fluid communication with a bore formed in the tool string;

contacting a subterranean formation with the distal end of the shaft; and pushing off of the formation with the shaft;

wherein a position of the shaft is determined by at least a combination of a formation pressure and a fluid bore pressure generated by drilling mud.

11. The method of claim 10, wherein pushing off the formation occurs automatically in response to changes in formation pressure.

12. The method of claim 10, wherein the method further comprises a step of contacting the formation by the working portion before the shaft contacts the formation.

13. The method of claim 10, wherein contacting the subterranean formation also reduces bit whirl.

14. The method of claim 10, wherein pushing off of the formation with the shaft is achieved by increasing pressure in the bore of the downhole tool string.

15. The method claim 14, wherein the pressure in the bore is increased by forcing more drilling mud into the bore.

16. The method of claim 10, wherein the jackleg is substantially coaxial with the drill bit assembly.

* * * * *